US010756469B2

(12) United States Patent
Behrendt et al.

(10) Patent No.: US 10,756,469 B2
(45) Date of Patent: Aug. 25, 2020

(54) ELECTRIC PLUG OF AN ELECTRIC PLUG CONNECTION COMPRISING THE PLUG AND A MATING PLUG

(71) Applicant: KNORR-BREMSE SYSTEME FUER NUTZFAHRZEUGE GMBH, Munich (DE)

(72) Inventors: Norbert Behrendt, Nuremberg (DE); Joerg Schneider, Schwieberdingen (DE); Andre Richter, Ludwigsburg (DE)

(73) Assignee: KNORR-BREMSE SYSTEME FUER NUTZFAHRZEUGE GMBH, Munich (DE)

( * ) Notice: Subject to any disclaimer, the term of this patent is extended or adjusted under 35 U.S.C. 154(b) by 0 days.

(21) Appl. No.: 16/477,404

(22) PCT Filed: Jan. 4, 2018

(86) PCT No.: PCT/EP2018/050174

§ 371 (c)(1),
(2) Date: Jul. 11, 2019

(87) PCT Pub. No.: WO2018/130452

PCT Pub. Date: Jul. 19, 2018

(65) Prior Publication Data

US 2020/0028293 A1 Jan. 23, 2020

(30) Foreign Application Priority Data

Jan. 12, 2017 (DE) ..... 10 2017 100 538

(51) Int. Cl.

| | |
|---|---|
| ***H01R 12/91*** | (2011.01) |
| ***H01R 12/71*** | (2011.01) |
| ***H01R 13/631*** | (2006.01) |

(52) U.S. Cl.
CPC ..... *H01R 12/91* (2013.01); *H01R 12/716* (2013.01); *H01R 13/6315* (2013.01)

(58) Field of Classification Search
CPC ... H01R 12/91; H01R 12/716; H01R 13/6315
See application file for complete search history.

(56) References Cited

U.S. PATENT DOCUMENTS 4,509,258 A * 4/1985 Locati ..... H01R 43/00 29/747
4,707,045 A * 11/1987 Ney ..... H01R 13/5221 439/252

(Continued)

FOREIGN PATENT DOCUMENTS

DE 19919598 A1 2/2000
DE 10114215 A1 10/2001

(Continued)

OTHER PUBLICATIONS

International Search Report dated May 24, 2018, of the corresponding International Application PCT/EP2018/050174 filed Jan. 4, 2018.

*Primary Examiner* — Truc T Nguyen
(74) *Attorney, Agent, or Firm* — Norton Rose Fulbright US LLP; Gerard Messina

(57) ABSTRACT

An electrical plug (EP) of an electrical plug-in (EPI) connection, including the plug and mating plug (MP), an electrical connection between EPI contacts of the plug contacts (PC) and mating contacts (MC) of the MP occurring when the plug and MP are inserted into each other, including: at least one connector strip (CS) in which EPI contacts, for electrical connection to MCs of the MP, are held by a first end; a free second end (FSE) of the EPI contacts projects away from the CS; a plug-in contact receiving chamber (PCRC) having subchamber bodies (SBs), the FSE of at least one of the EPI contacts projects into each of the SBs;

(Continued)

the PCRC being open in the direction of the FSEs of the EPI contacts, the CS and the PCRC being separate components connected to one another, and at least two SBs of the PCRC being connected to one another by an elastic element permitting relative movement of the SBs in a plane perpendicular as to the EPI contacts.

19 Claims, 3 Drawing Sheets

(56) References Cited

U.S. PATENT DOCUMENTS 4,738,628 A * 4/1988 Rees ..... H01R 13/648 439/332
6,227,904 B1 * 5/2001 Wang ..... H01R 13/6583 439/541.5
9,490,570 B1 * 11/2016 Hashiguchi ..... H01R 13/502
9,882,317 B1 * 1/2018 Lane ..... H01R 13/4223
2007/0059970 A1 * 3/2007 Ichio ..... H01R 13/6272 439/382
2008/0050957 A1 * 2/2008 Natter ..... H01R 27/02 439/296
2008/0227332 A1 * 9/2008 Blakborn ..... H01R 13/6315 439/578
2009/0264021 A1 * 10/2009 Feldner ..... H01R 13/58 439/660
2010/0081340 A1 * 4/2010 Fogg ..... H01R 13/514 439/701
2010/0267270 A1 * 10/2010 Jehmlich ..... H01R 13/6315 439/357
2012/0178303 A1 * 7/2012 Sakurai ..... H01R 13/6315 439/638
2013/0149918 A1 * 6/2013 Kawai ..... H01R 13/426 439/754
2013/0316591 A1 * 11/2013 White ..... H01R 13/6315 439/660
2014/0011396 A1 1/2014 Ritter et al.
2014/0024266 A1 * 1/2014 Kashiwada ..... H01R 13/6315 439/686
2014/0206232 A1 * 7/2014 Kato ..... H01R 9/037 439/607.5
2015/0118904 A1 * 4/2015 Baechle ..... H01R 12/716 439/591
2016/0043492 A1 * 2/2016 Nakai ..... H01R 13/4226 439/752

FOREIGN PATENT DOCUMENTS

DE 102006013948 A1 10/2007
DE 102009029545 A1 3/2011
DE 102015209401 A1 11/2016
EP 0301721 A1 2/1989
EP 1833123 A1 9/2007
WO 2008/049610 A1 5/2008
WO 2010/094481 A2 8/2010

* cited by examiner

ELECTRIC PLUG OF AN ELECTRIC PLUG CONNECTION COMPRISING THE PLUG AND A MATING PLUG

FIELD OF THE INVENTION

The invention relates to an electrical plug of an electrical plug-in connection comprising the plug and a mating plug, wherein an electrical connection between electrical plug-in contacts of the plug and mating contacts of the mating plug is produced when said plug and mating plug are inserted one into the other, wherein the electrical plug has at least the following: at least one connector strip in which a plurality of electrical plug-in contacts, which are provided for electrical connection to mating contacts of the mating plug, are held by way of a first end, wherein a free second end of the electrical plug-in contacts projects away from the connector strip in each case, a plug-in contact receiving chamber which has at least two subchamber bodies, wherein the free second end of at least one of the electrical plug-in contacts projects into each of the subchamber bodies, wherein the plug-in contact receiving chamber is open in the direction of the free second ends of the electrical plug-in contacts. Furthermore, the invention also relates to an electrical plug-in connection comprising the plug and a mating plug, wherein an electrical connection between electrical plug-in contacts of the plug and mating contacts of the mating plug is produced when said plug and mating plug are inserted one into the other, comprising at least one plug of said kind, and also to an electric or electropneumatic brake device of a vehicle comprising at least one electrical plug-in connection of said kind.

BACKGROUND INFORMATION

A plug of this kind and, respectively, an electrical plug-in connection of this kind are discussed, for example, in DE 101 14 215 B4. In the document, the connector strip and the plug-in contact receiving chamber, which has two subchamber bodies each with a plug-in contact in said document, are of an integral configuration. However, a configuration of this kind is believed to be disadvantageous in respect of the tolerances which have to be complied with.

SUMMARY OF THE INVENTION

In contrast, the invention is based on the object of developing an electrical plug, an electrical plug-in connection and also an electric or electropneumatic brake device of a vehicle of the kind mentioned at the outset in such a way that said electrical plug, electrical plug-in connection or electric or electropneumatic brake device has less stringent requirements in respect of the manufacturing tolerances.

According to the invention, this object may be achieved by the features described herein.

The invention is based on an electrical plug of an electrical plug-in connection comprising the plug and a mating plug, wherein an electrical connection between electrical plug-in contacts of the plug and mating contacts of the mating plug is produced when said plug and mating plug are inserted one into the other. In this case, the electrical plug can be configured as a "male" plug or as a "female" plug.

The electrical plug has at least the following: at least one connector strip in which a plurality of electrical plug-in contacts, which are provided for electrical connection to mating contacts of the mating plug, are held by way of a first end, wherein a free second end of the electrical plug-in contacts projects away from the connector strip in each case, a plug-in contact receiving chamber which has at least two subchamber bodies, wherein the free second end of at least one of the electrical plug-in contacts projects into each of the subchamber bodies, wherein the plug-in contact receiving chamber is open in the direction of the free second ends of the electrical plug-in contacts.

According to the invention, the connector strip and the plug-in contact receiving chamber constitute separate components and are connected to one another, wherein at least two subchamber bodies of the plug-in contact receiving chamber are connected to one another by at least one elastic element which permits a relative movement of the subchamber bodies at least in a plane which is perpendicular in relation to the electrical plug-in contacts and in particular also in a plane which is perpendicular in relation to the connector strip. Furthermore, an orientation of the at least two subchamber bodies of the plug-in contact receiving chamber with respect to the connector strip is then also possible.

At least one subchamber body is then open in the direction of the free end of the at least one electrical plug-in contacts which it accommodates. Each subchamber body accommodates free second ends of a specific number n of electrical plug-in contacts and in this way forms, in particular, a subchamber body of a (dedicated) n-pole plug element, wherein n is a number greater than or equal to 1.

As a result, it is possible to produce electrical plugs having a plug-in contact receiving chamber with a plurality of subchamber bodies, without high demands having to be made in respect of the manufacturing tolerances in terms of the distances of the subchamber bodies from one another. This is because the at least one elastic element, which connects in each case two subchamber bodies to one another, allows tolerance compensation at least in the plane perpendicular in relation to the electrical plug-in contacts.

When, furthermore, for example the connector strip carries at least one printed circuit board which is populated by an electronics circuit to which the first end of at least one electrical plug-in contact is connected, for example by pressing the first end of the at least one electrical plug-in contact into the printed circuit board, the connector strip and the printed circuit board(s) can then be prefabricated in a single soldering or pressing-in process in line with the high requirements in respect of the cleanliness of the manufacturing environment, for example in an electronics business which specializes in this field. Following this, the connection between the connector strip and the plug-in contact receiving chamber or the at least two subchamber bodies can then be finished in a manufacturing environment which has less stringent requirements in respect of the cleanliness of the manufacturing environment, for example on the end customer's premises.

Advantageous developments of and improvements to the invention are possible owing to the measures described herein.

The at least two subchamber bodies of the plug-in contact receiving chamber particularly may be injection moldings composed of plastic in each of which at least one section of the elastic element is injected at least partially into subchamber body walls of the subchamber bodies during injection molding of the subchambers. The plug-in contact receiving chamber together with the elastic element is then manufactured in a single injection-molded manufacturing step.

As an alternative, the elastic element could be connected to the subchamber bodies by any other connection, for example by frictional connection, interlocking connection or cohesive connection (adhesive bonding). In particular, the at least one elastic element or else only a portion of it could also be clamped between adjacent subchamber bodies.

The elastic element may be formed by a thermoplastic elastomer which is formed, for example, as a profile strip with a T-shaped cross section, wherein transverse sections of the profile strip with a T-shaped cross section are each at least partially injected into a subchamber wall and a middle section is arranged between the subchamber bodies.

The elastic element particularly may additionally constitute a sealing element which provides sealing against the connector strip and/or against a housing for the electrical plug-in connection. Therefore, the elastic element performs an advantageous double function by way of serving firstly for tolerance compensation and secondly as a sealing element at the same time.

At least one subchamber body of the plug-in contact receiving chamber may extend beyond the free second end of the at least one electrical plug-in contact. According to one development, at least one subchamber body of the plug-in contact receiving chamber can completely enclose the free second ends of the at least one electrical plug-in contacts at a radial distance. Therefore, the at least one electrical plug-in contact, with the exception of the opening in the direction of the free second end, is completely accommodated in the subchamber body. As an alternative, the free second end of at least one electrical plug-in contact could also project beyond at least one subchamber body of the plug-in contact receiving chamber.

At least one subchamber body of the plug-in contact receiving chamber may have at least one interlocking element for interlocking connection to a mating interlocking element of the mating plug, in particular at least one peg for insertion into a slotted guide of the mating plug. The interlocking element or the peg is, for example, integrally formed with the subchamber body and can be, for example, a protruding lug which is provided for engagement into a complementary slotted guide in the mating plug, so that an interlocking connection is produced.

The connector strip on the one hand and the at least two subchamber bodies of the plug-in contact receiving chamber on the other hand may particularly be connected to one another by a first press fit which can be produced, reinforced or fixed by a screw connection in particular.

According to an exemplary implementation of this measure, the at least two subchamber bodies can each have a passage opening and the connector strip can have at least two bosses, wherein in each case one boss from amongst the bosses is held in in each case one passage opening of a subchamber body by the first press fit. In this case, the elastic element also ensures equalization of distance or axis errors between the subchamber bodies.

The connector strip and the at least two subchamber bodies of the plug-in contact receiving chamber can form a structural unit which is detachably fastened to a housing for the plug. In this case, the detachable fastening of the structural unit to the housing for the plug can be implemented by a second press fit of the structural unit in at least one opening of the housing for the plug.

In this case, screws of a screw connection between the connector strip on the one hand and the at least two subchamber bodies of the plug-in contact receiving chamber on the other hand, which screws are screwed in in the region of the first second press fit and/or of the second press fit, can cause an expansion in material which establishes and secures the first press fit and/or the second press fit or increases the pressing of said press fit, wherein this expansion in material causes radial bracing of the respective inner part in the respective outer part of the press fit in question.

The connector strip particularly may carry at least one printed circuit board which is populated by an electronics circuit and to which the first end of at least one electrical plug-in contact is connected. In particular, a dedicated printed circuit board which is populated by an electronics circuit can also be provided for each subchamber body. A dedicated printed circuit board which is populated by an electronics circuit is then associated with each plug element which has a subchamber body and a number n of electrical plug-in contacts. Consequently, it is then possible for each of the plug elements to transmit electrical signals of a function or receive said electrical signals from the mating plug, which function is implemented in the respective electronics circuit.

It is also conceivable for the electronics circuit to constitute or comprise a power electronics system or an output stage, so that, in addition to or instead of function signals, electric currents are transmitted to or from the mating plug by the plug element. The printed circuit boards with the electronics circuits may be arranged on a surface of the connector strip which faces away from the subchamber bodies.

The first end of at least one electrical plug-in contact can be soldered to the printed circuit board which is populated by the electronics circuit, or contact-connected with a press fit.

The invention also proposes an electrical plug-in connection comprising the plug and a mating plug, wherein an electrical connection between electrical plug-in contacts of the plug and mating contacts of the mating plug is produced when said plug and mating plug are inserted one into the other, which electrical plug-in connection comprises at least one plug as described above.

Furthermore, the invention also proposes an electric or electropneumatic brake device of a vehicle, in particular a parking brake device, which comprises at least one electrical plug-in connection as described above.

Further measures which improve the invention will be presented in more detail below together with the description of an exemplary embodiment of the invention on the basis of the drawing.

The drawings illustrate exemplary embodiment(s) of the invention.

DETAILED DESCRIPTION

Figure 1A:
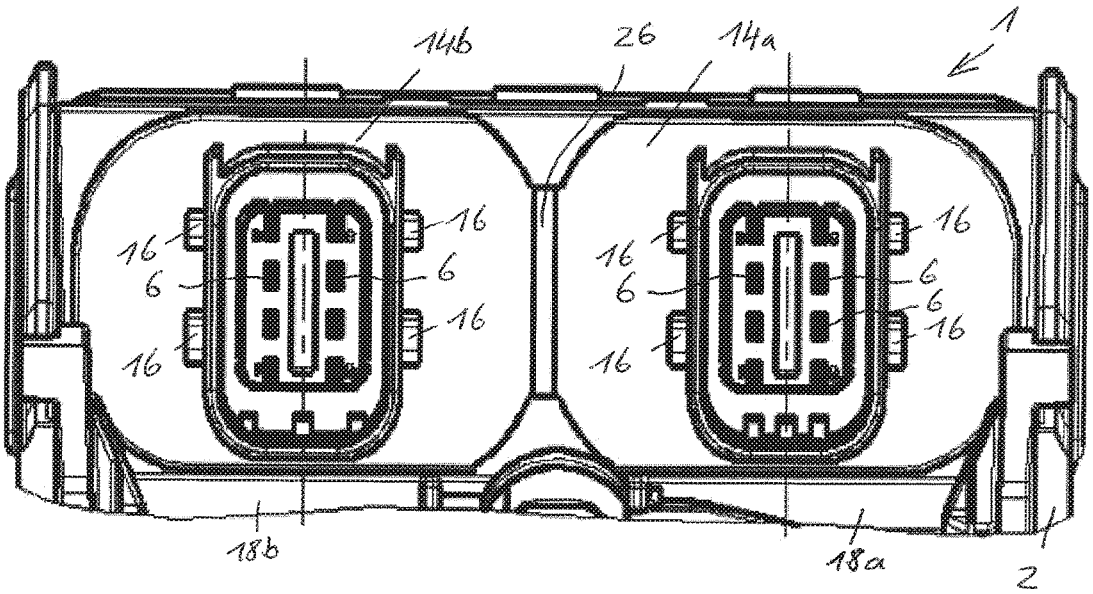
FIG. 1A shows a front view of an electrical plug of an electrical plug-in connection in the installed position on a housing according to an exemplary embodiment of the invention.

FIG. 1A to FIG. 3 show an exemplary embodiment of an electrical plug 1 of an electrical plug-in connection and how it forms the electrical plug-in connection together with a mating plug, not shown here. The mating plug may be a cable harness plug which is fastened to one end of a flexible cable harness. The electrical plug 1 may be fixed in a stationary manner on a housing 2 and can be configured as a "male" plug or as a "female" plug. Here, the electrical plug-in connection may be part of an item of electrical equipment of an electric or electropneumatic parking brake device of a vehicle.

The electrical plug 1 has a connector strip 4 in which a plurality of electrical plug-in contacts 6 which are provided for electrical connection to mating contacts of the mating plug are held by way of a first end 8. The connector strip 4 may be an injection molding composed of plastic, wherein at least a portion of the first ends 8 of the electrical plug-in contacts 6 are jointly potted in such a way during injection molding that they still project to a certain extent out of a surface of the connector strip 4 which faces away from a plug-in contact receiving chamber 10. Free second ends 12 of the electrical plug-in contacts 6 each project away from the connector strip 4.

Furthermore, the electrical plug 1 has the plug-in contact receiving chamber 10 which here comprises, for example, two subchamber bodies 14*a*, 14*b*, wherein second free ends 12 of a specific number of electrical plug-in contacts 6 project into each of the subchamber bodies 14*a*, 14*b*. The plug-in contact receiving chamber 10 is open in the direction of the free second ends 12 of the electrical plug-in contacts 6, so that the mating contacts of the mating plug can make contact with the free second ends 12 of the electrical plug-in contacts 6. It is clear here that the plug-in contact receiving chamber 10 can also comprise more than two subchamber bodies 14*a*, 14*b*.

The two subchamber bodies 14*a*, 14*b* are open in the direction of the free second ends 12 of those electrical plug-in contacts 6 which are accommodated by the subchamber body 14*a* or 14*b* in question perpendicular in relation to the plug-in direction of the electrical plug-in contacts 6. Here, each subchamber body 14*a*, 14*b* accommodates, for example, free second ends 12 of a specific number n of electrical plug-in contacts 6 and in this way forms, in particular, a subchamber body 14*a*, 14*b* of an n-pole plug element 15*a*, 15*b*, wherein n is a number greater than or equal to 1.

The two subchamber bodies 14*a*, 14*b* of the plug-in contact receiving chamber may extend beyond the free second ends 12 of the electrical plug-in contacts 6 and past them. For example, the two subchamber bodies 14*a*, 14*b* of the plug-in contact receiving chamber 10 each also completely enclose the free second ends 12 of the associated electrical plug-in contacts 6. As an alternative, the free second ends 12 of the electrical plug-in contacts 6 could each also project beyond the subchamber body 14*a*, 14*b* in question of the plug-in contact receiving chamber 10.

The subchamber bodies 14*a*, 14*b* of the plug-in contact receiving chamber 10 may have pegs 16 for engaging in an interlocking manner in a slotted guide of the mating plug. The pegs 16 are, for example, integrally formed with the subchamber bodies 14*a*, 14*b*, jut radially outwardly as shown here and are provided for engaging in an interlocking manner in a complementary slotted guide in the mating plug, so that an interlocking connection is produced by insertion and relative rotation of the plug and the mating plug.

Here, the connector strip 4 particularly may carry, for example, two printed circuit boards 18*a*, 18*b* which are each populated by an electronics circuit and to which the first ends 8 of the electrical plug-in contacts 6 are connected. In this case, a dedicated printed circuit board 18*a*, 18*b* which is populated by an electronics circuit is provided for each subchamber body 14*a*, 14*b* in particular. A dedicated printed circuit board 18*a*, 18*b* which is populated by an electronics circuit may then be associated with each plug element 15*a*, 15*b* which has a subchamber body 14*a*, 14*b* and a number n of electrical plug-in contacts 6. The electrical plug-in contacts 6 are, in particular, parallel in relation to the plug axes 32 of the plug elements 15*a*, 15*b*. As an alternative, just one single printed circuit board could also be provided for both subchamber bodies 14*a*, 14*b*, all of the first ends 8 of the electrical plug-in contacts 6 then being connected to said printed circuit board.

Consequently, it is then possible for each of the plug elements 15*a*, 15*b* to transmit electrical signals of a function or to receive said electrical signals from the mating plug, which function is implemented in the respective electronics circuit. It is also conceivable for the electronics circuit to constitute or comprise a power electronics system or an output stage, so that, in addition to or instead of function signals, electric currents are transmitted to or from the mating plug by the plug element 15*a*, 15*b*.

Those sections of the first ends 8 of the electrical plug-in contacts 6 which project out of the connector strip 4 away from the plug-in contact receiving chamber 10 may each be pressed into the associated printed circuit board 18*a*, 18*b* which is populated by the electronics circuit, or are soldered to said printed circuit board. The printed circuit boards 18*a*, 18*b* having the electronics circuits or the single printed circuit board are/may be arranged on a surface of the connector strip 4 which faces away from the subchamber bodies 14*a*, 14*b*.

Figure 3:
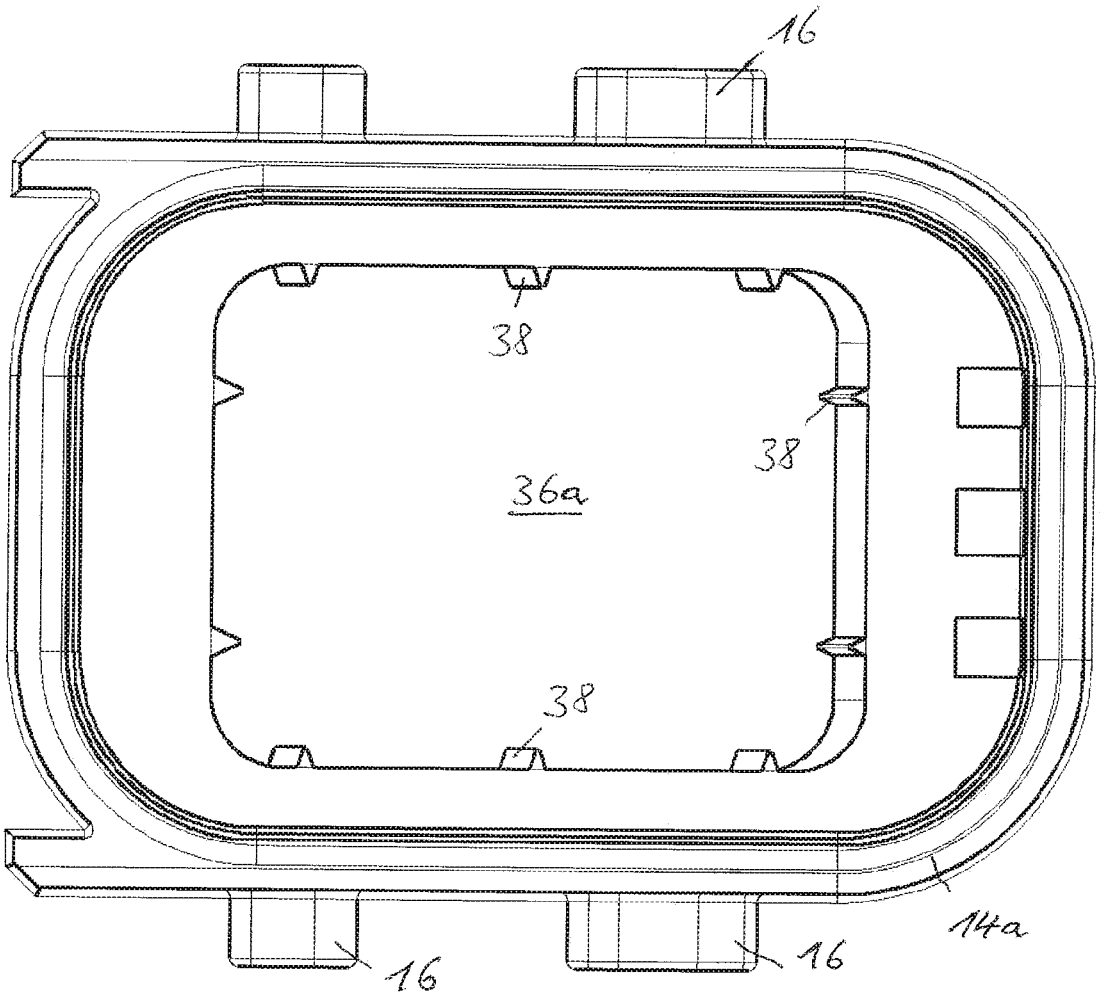
FIG. 3 shows a separate illustration of a subchamber body of a plug-in contact receiving chamber of the plug.

The connector strip 4 on the one hand and the plug-in contact receiving chamber 10 with the two subchamber bodies 14*a*, 14*b* on the other hand constitute separate components and here are connected to one another to one another, for example, by a press connection which is, for example, additionally secured by a screw connection 20 here. Here, the screws 22 of the screw connection 20 may be held in screw bosses 24 in the connector strip 4 and in the subchamber bodies 14*a*, 14*b*. The press connection between the connector strip 4 on the one hand and the two subchamber bodies 14*a*, 14*b* on the other hand is established, for example, by way of, as shown in FIG. 3, the two subchamber bodies 14*a*, 14*b* each a passage opening 36*a*, 36*b* on at the inner edge of which pinch ribs 38 are formed, wherein the connector strip 4 has two bosses 40*a*, 40*b* which face in the direction of the plug-in contacts 6 and project into the passage openings 36*a*, 36*b* of the subchamber bodies 14*a*, 14*b*. The bosses 40*a*, 40*b* of the connector strip then center the subchamber bodies 14*a*, 14*b* on them.

In this case, the pinch ribs 38 of the subchamber bodies 14*a*, 14*b* and the bosses 40*a*, 40*b* of the connector strip 4 which are held in or by said pinch ribs are dimensioned in such a way that the pinch ribs 38 plastically deform when the bosses 40*a*, 40*b* are inserted and therefore a respective first press fit can be formed between one boss 40*a*, 40*b* of the connector strip 4 and one subchamber body 14*a*, 14*b*. In this case, the elastic element 26 also ensures equalization of distance or axis errors between the subchamber bodies 14*a*, 14*b*. When the screws 22 of the screw connection 20 are then screwed into the associated screw bosses 24, the screws 22 have a widening effect on the walls of the subchamber bodies 14*a*, 14*b* in the region of the passage openings 36*a*, 36*b*, so that the pressing of the first press fit is increased and, respectively, the first press fit is secured in this way.

Here, the two subchamber bodies 14*a*, 14*b* of the plug-in contact receiving chamber 10 are among each other connected to one another by, for example, a single elastic element 26 which allows a relative movement of the subchamber bodies 14*a*, 14*b* at least in a plane which is perpendicular in relation to the electrical plug-in contacts 6.

The two subchamber bodies 14*a*, 14*b* of the plug-in contact receiving chamber 10 may be injection moldings composed of plastic in each of which, for example, at least one section of the elastic element 26 is injected at least partially into the respective subchamber body wall during injection molding of the subchamber bodies 14*a*, 14*b*. The plug-in contact receiving chamber 10 is then manufactured in a single injection-molding manufacturing step. As an alternative, the elastic element 26 could also be connected to the subchamber bodies 14*a*, 14*b* by any other connection or only be in contact with said subchamber bodies, for example by frictional connection, interlocking connection, cohesive connection (adhesive bonding). In particular, the elastic element 26 or else portions of it can be clamped in an interlocking and/or frictional manner between adjacent subchamber bodies 14*a*, 14*b*.

The elastic element 26 may be formed by a thermoplastic elastomer which here is formed, for example, as a profile strip with a T-shaped cross section, wherein transverse sections of the profile strip with a T-shaped cross section are each partially injected into a subchamber body wall of a subchamber body 14*a*, 14*b* and a middle section is arranged between the subchamber bodies 14*a*, 14*b*.

The preassembled structural unit which forms the plug 1 and is composed of the connector strip 4, the two subchamber bodies 14*a*, 14*b* of the plug-in contact receiving chamber 10 and the elastic element 26 may be held in openings 28*a*, 28*b* of the housing 2 by a second press fit which is established and secured by the screws 22 of the screw connection 20 or the pressing of which is increased by the screws 22 because the screws 22 provide for expansion of material of the connector strip 4 in the region of the openings 28*a*, 28. Here, the housing 2 constitutes, for example, a cast part composed of metal.

Figure 1B:
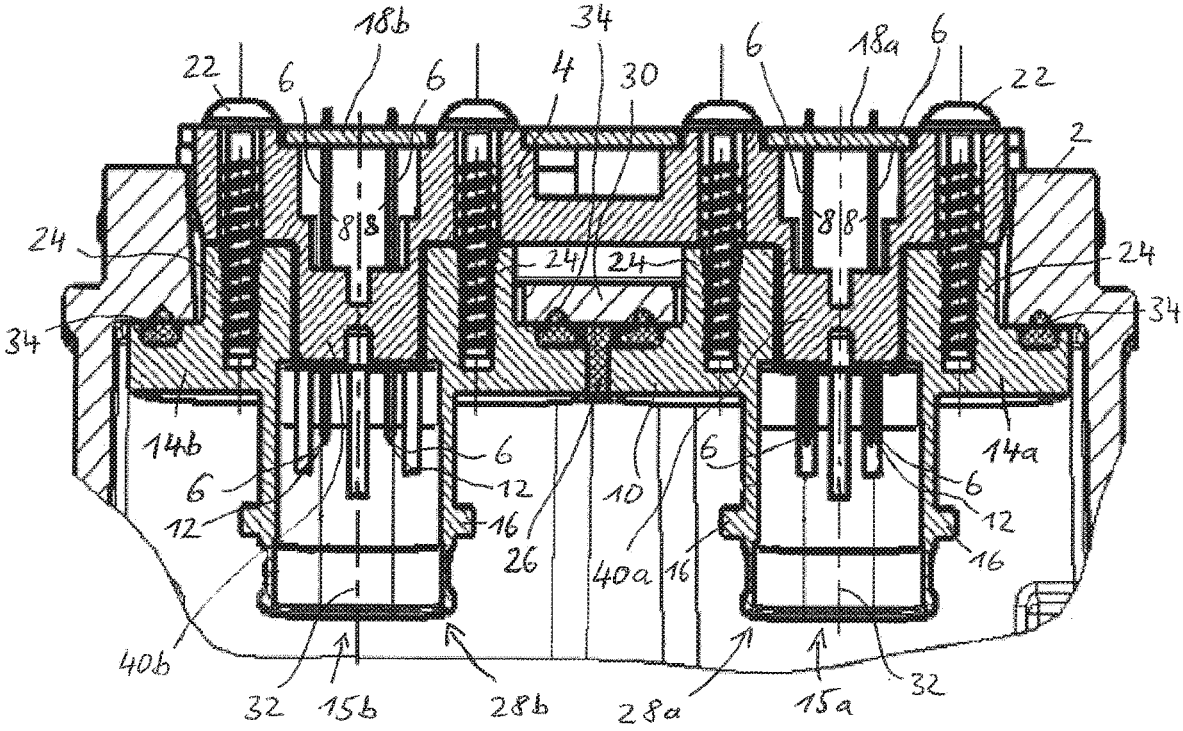
FIG. 1B shows a cross-sectional illustration of the plug from FIG. 1.
Figure 2A:
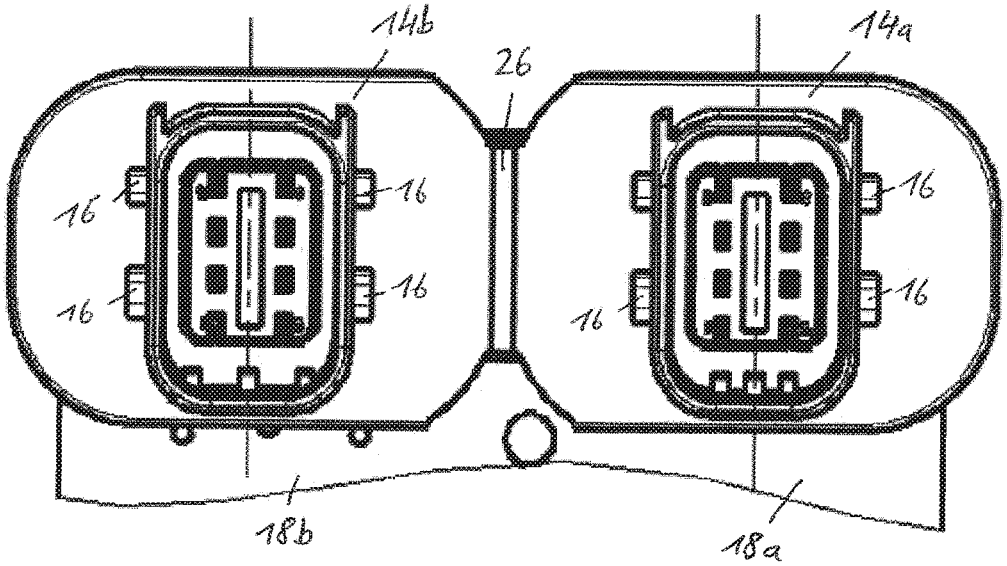
FIG. 2A shows a front view of the electrical plug from FIG. 1 and FIG. 2 in a separate illustration.
Figure 2B:
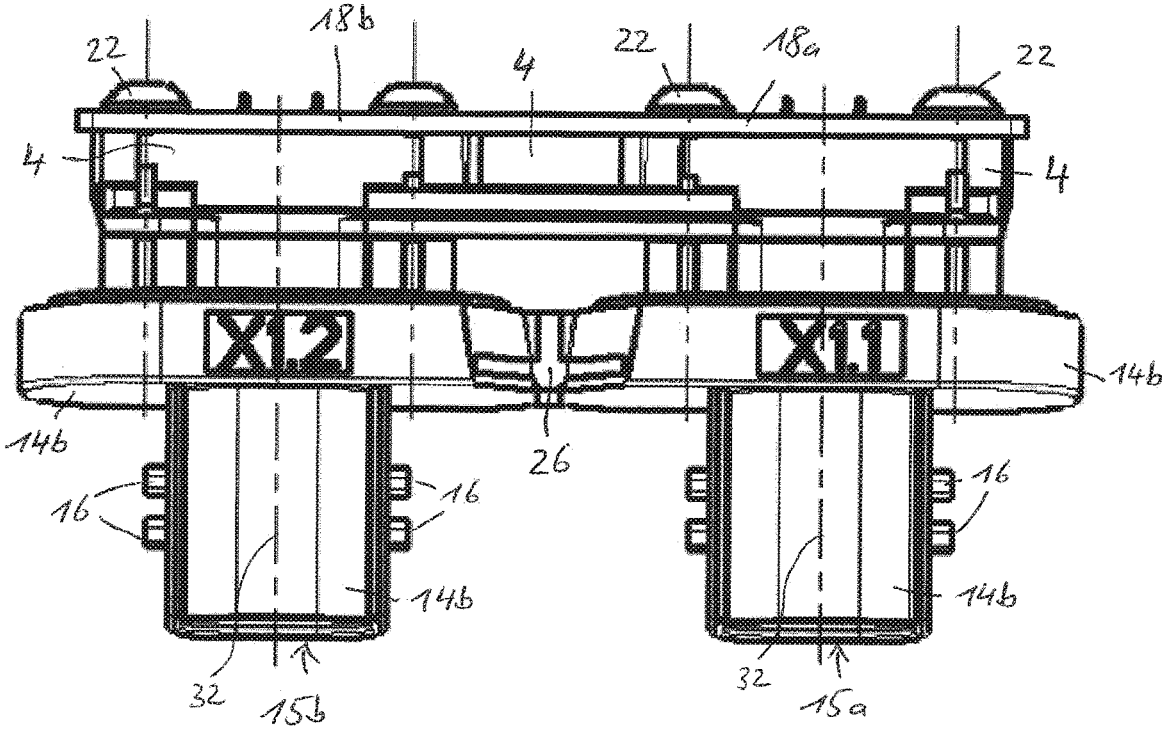
FIG. 2B shows a side view of the electrical plug from FIG. 1 and FIG. 2 in a separate illustration.

The elastic element 26 may be arranged on a surface of the plug-in contact receiving chamber 10 which faces the connector strip 4 and, for example, additionally constitutes a sealing element which here, for example, in the mounted state of the electrical plug 1 provides sealing against a section 30 of the housing 2 between the openings 28*a*, 28*b* of the carrier 2, as shown in FIG. 1B in particular. This section 30 of the housing 2 may then be arranged between the connector strip 4 and the plug-in contact receiving chamber 10 in the mounted state of the electrical plug 1. As a result, the elastic element 26 contributes to sealing off the printed circuit boards 18*a*, 18*b*, which are populated by the electronics circuits, from the surrounding area. The elastic element 26 may have additional projections for this purpose which act as sealing lips in relation to the housing 2 or in relation to the section 30 30 of said housing. Furthermore, each subchamber body 14*a*, 14*b* may carry additional sealing elements 34, for example in the form of sealing rings for sealing off in relation to the housing 2.

THE LIST OF REFERENCE SYMBOLS IS AS FOLLOWS

1 Electrical plug
2 Housing
4 Connector strip
6 Electrical plug-in contacts
8 First end
10 Plug-in contact receiving chamber
12 Free second end
14*a/b* Subchamber body
15*a/b* Plug element
16 Peg
18*a/b* Printed circuit boards
20 Screw connection
22 Screws
24 Screw bosses
26 Elastic element
28*a/b* Openings
30 Section
32 Plug axes
34 Sealing elements
36*a/b* Passage opening
38 Pinch ribs
40*a/b* Bosses

The invention claimed is:

1. An electrical plug of an electrical plug-in connection, which includes the plug and a mating plug, wherein an electrical connection between electrical plug-in contacts of the plug and mating contacts of the mating plug is provided when the plug and mating plug are inserted one into the other, comprising:

at least one connector strip in which a plurality of electrical plug-in contacts, which are provided for electrical connection to mating contacts of the mating plug, are held by way of a first end, wherein a free second end of the electrical plug-in contacts projects away from the connector strip in each case;

a plug-in contact receiving chamber which has at least two subchamber bodies, wherein the second free end of at least one of the electrical plug-in contacts projects into each of the subchamber bodies;

wherein the plug-in contact receiving chamber is open in the direction of the free second ends of the electrical plug-in contacts, wherein the connector strip and the plug-in contact receiving chamber constitute separate components and are connected to one another, and wherein the at least two subchamber bodies of the plug-in contact receiving chamber are connected to one another by at least one elastic element which permits a relative movement of the subchamber bodies at least in a plane which is perpendicular in relation to the electrical plug-in contacts.

2. The electrical plug of claim 1, wherein the at least two subchamber bodies of the plug-in contact receiving chamber are injection moldings composed of plastic in each of which at least one section of the elastic element is injected at least partially into subchamber body walls of the subchamber bodies during injection molding of the subchamber bodies.

3. The electrical plug of claim 1, wherein the elastic element is formed by a thermoplastic elastomer.

4. The electrical plug of claim 1, wherein the elastic element additionally constitutes a sealing element which provides sealing against the connector strip and/or against a housing for the electrical plug.

5. The electrical plug of claim 1, wherein at least one subchamber body of the plug-in contact receiving chamber extends beyond the free second end of the at least one electrical plug-in contact.

6. The electrical plug of claim 1, wherein at least one subchamber body of the plug-in contact receiving chamber completely encloses the free second end of the at least one electrical plug-in contact at a radial distance.

7. The electrical plug of claim 1, wherein at least one subchamber body of the plug-in contact receiving chamber has at least one interlocking element for interlocking connection to a mating interlocking element of the mating plug.

8. The electrical plug of claim 1, wherein the connector strip and the at least two subchamber bodies of the plug-in contact receiving chamber are detachably connected to one another.

9. The electrical plug of claim 8, wherein the at least two subchamber bodies of the plug-in contact receiving chamber and the connector strip are connected to one another by a first press fit.

10. The electrical plug of claim 9, wherein the at least two subchamber bodies each have a passage opening and the connector strip has at least two bosses, wherein in each case one boss from amongst the bosses is held in in each case one passage opening of a subchamber body by the first press fit.

11. The electrical plug of claim 1, wherein the connector strip and the at least two subchamber bodies of the plug-in contact receiving chamber form a structural unit which is detachably fastened to a housing for the plug.

12. The electrical plug of claim 11, wherein the detachable fastening of the structural unit to the housing for the plug is implemented by a second press fit of the structural unit in at least one opening of the housing for the plug.

13. The electrical plug of claim 10, wherein screws of a screw connection between the connector strip on the one hand and the at least two subchamber bodies of the plug-in contact receiving chamber on the other hand, which screws are screwed in in the region of the first press fit and/or of the second press fit, cause an expansion in material which establishes and secures the first press fit and/or the second press fit or increases the pressing of said press fit.

14. The electrical plug of claim 1, wherein the connector strip carries at least one printed circuit board which is populated by an electronics circuit and to which the first end of at least one electrical plug-in contact is connected.

15. The electrical plug of claim 14, wherein a single printed circuit board which is populated by an electronics circuit is provided for the at least two subchamber bodies, or a dedicated printed circuit board which is populated by an electronics circuit is provided for each subchamber body.

16. The electrical plug of claim 15, wherein a plug element of the electrical plug in each case has a subchamber body, at least one electrical plug-in contact and also a dedicated printed circuit board which is populated by an electronics circuit.

17. The electrical plug of claim 14, wherein the first end of at least one electrical plug-in contact is pressed into the at least one printed circuit board which is populated by the electronics circuit, or is soldered to said printed circuit board.

18. An electrical plug-in connection, comprising:

a plug; and a mating plug, wherein an electrical connection between electrical plug-in contacts of the plug and mating contacts of the mating plug is produced when the plug and mating plug are inserted one into the other;

wherein the plug includes at least one electrical plug, the at least one electrical plug including:

at least one connector strip in which a plurality of electrical plug-in contacts, which are provided for electrical connection to mating contacts of the mating plug, are held by way of a first end, wherein a free second end of the electrical plug-in contacts projects away from the connector strip in each case;

a plug-in contact receiving chamber which has at least two subchamber bodies, wherein the second free end of at least one of the electrical plug-in contacts projects into each of the subchamber bodies;

wherein the plug-in contact receiving chamber is open in the direction of the free second ends of the electrical plug-in contacts, wherein the connector strip and the plug-in contact receiving chamber constitute separate components and are connected to one another, and wherein the at least two subchamber bodies of the plug-in contact receiving chamber are connected to one another by at least one elastic element which permits a relative movement of the subchamber bodies at least in a plane which is perpendicular in relation to the electrical plug-in contacts.

19. An electric or an electro-pneumatic brake device of a vehicle, comprising:

at least one electrical plug-in connection, including:

a plug; and a mating plug, wherein an electrical connection between electrical plug-in contacts of the plug and mating contacts of the mating plug is produced when the plug and mating plug are inserted one into the other;

wherein the plug includes at least one electrical plug, the at least one electrical plug including:

at least one connector strip in which a plurality of electrical plug-in contacts, which are provided for electrical connection to mating contacts of the mating plug, are held by way of a first end, wherein a free second end of the electrical plug-in contacts projects away from the connector strip in each case;

a plug-in contact receiving chamber which has at least two subchamber bodies, wherein the second free end of at least one of the electrical plug-in contacts projects into each of the subchamber bodies;

wherein the plug-in contact receiving chamber is open in the direction of the free second ends of the electrical plug-in contacts, wherein the connector strip and the plug-in contact receiving chamber constitute separate components and are connected to one another, and wherein the at least two subchamber bodies of the plug-in contact receiving chamber are connected to one another by at least one elastic element which permits a relative movement of the subchamber bodies at least in a plane which is perpendicular in relation to the electrical plug-in contacts.

* * * * *